US010775080B2

(12) United States Patent
Frantz et al.

(10) Patent No.: US 10,775,080 B2
(45) Date of Patent: Sep. 15, 2020

(54) LNG GASIFICATION SYSTEMS AND METHODS

(71) Applicant: Crowley Maritime Corporation, Jacksonville, FL (US)

(72) Inventors: Kevin Frantz, Jacksonville, FL (US); John Gonzalez, Jacksonville, FL (US)

(73) Assignee: Crowley Maritime Corporation, Jacksonville, FL (US)

( * ) Notice: Subject to any disclaimer, the term of this patent is extended or adjusted under 35 U.S.C. 154(b) by 0 days.

(21) Appl. No.: 15/669,395

(22) Filed: Aug. 4, 2017

(65) Prior Publication Data

US 2018/0045441 A1 Feb. 15, 2018

Related U.S. Application Data

(63) Continuation of application No. 15/285,965, filed on Oct. 5, 2016, now abandoned.

(Continued)

(51) Int. Cl.

*F17C 9/02* (2006.01)
*F25B 23/00* (2006.01)

(Continued)

(52) U.S. Cl.

CPC ..... *F25B 23/006* (2013.01); *F17C 5/06* (2013.01); *F17C 7/04* (2013.01); *F17C 9/02* (2013.01);

(Continued)

(58) Field of Classification Search

CPC ..... F17C 9/02; F17C 9/04; F17C 2223/033; F17C 2223/035

See application file for complete search history.

(56) References Cited

U.S. PATENT DOCUMENTS 4,224,802 A 9/1980 Ooka
5,288,312 A * 2/1994 Payne ..... E21B 43/34 55/356

(Continued)

FOREIGN PATENT DOCUMENTS

EP 2682666 A1 1/2014
JP 2012-021837 A 2/2012

(Continued)

OTHER PUBLICATIONS

International Search Report dated Dec. 22, 2016 in International Patent Application No. PCT/US2016/055503. [Cited in Parent].

(Continued)

*Primary Examiner* — Brian M King
(74) *Attorney, Agent, or Firm* — Venable LLP; Michele V. Frank

(57) ABSTRACT

A skid for capturing refrigeration from liquefied natural gas vaporization is disclosed comprising a first heat exchanger mounted on the skid, the first heat exchanger having a natural gas inlet, a natural gas outlet, a process fluid inlet, and a process fluid outlet. The process fluid is configured to flow from the process fluid inlet through the first heat exchanger to the process fluid outlet and then to the process fluid inlet. Other embodiments of the system for capturing refrigeration from vaporization of liquid natural gas, and methods for its use, are described herein.

17 Claims, 9 Drawing Sheets

Related U.S. Application Data

(60) Provisional application No. 62/237,223, filed on Oct. 5, 2015.

(51) Int. Cl.
*F17C 9/04* (2006.01)
*F17C 5/06* (2006.01)
*F17C 7/04* (2006.01)

(52) U.S. Cl.
CPC ..... *F17C 9/04* (2013.01); *F17C 2221/033* (2013.01); *F17C 2223/0161* (2013.01); *F17C 2223/033* (2013.01); *F17C 2223/046* (2013.01); *F17C 2225/0123* (2013.01); *F17C 2225/035* (2013.01); *F17C 2227/0135* (2013.01); *F17C 2227/0309* (2013.01); *F17C 2227/0311* (2013.01); *F17C 2227/0327* (2013.01); *F17C 2227/0388* (2013.01); *F17C 2227/0393* (2013.01); *F17C 2250/032* (2013.01); *F17C 2250/0434* (2013.01); *F17C 2250/0439* (2013.01); *F17C 2250/0443* (2013.01); *F17C 2250/0495* (2013.01); *F17C 2260/046* (2013.01); *F17C 2265/05* (2013.01); *F17C 2270/0136* (2013.01); *F25B 2500/19* (2013.01); *F25B 2700/197* (2013.01); *F25B 2700/21172* (2013.01); *F25B 2700/21173* (2013.01)

(56) References Cited

U.S. PATENT DOCUMENTS 5,394,704 A * 3/1995 Johnson ..... F17C 13/026 62/122
7,726,874 B2 * 6/2010 Kirchberg ..... F28F 27/00 374/147
2002/0170297 A1 * 11/2002 Quine ..... F17C 7/04 62/50.2
2005/0126220 A1 6/2005 Ward
2007/0079617 A1 4/2007 Farmer et al.
2008/0178611 A1 * 7/2008 Ding ..... F17C 9/04 62/50.2
2008/0302519 A1 12/2008 Franklin et al.
2009/0211263 A1 8/2009 Coyle
2010/0229573 A1 * 9/2010 Ehrstrom ..... F17C 5/06 62/50.2
2010/0263389 A1 10/2010 Bryngelson et al.
2011/0297346 A1 12/2011 Minta et al.
2012/0222430 A1 9/2012 Madsen
2012/0234024 A1 * 9/2012 Street ..... F17C 5/06 62/48.1
2013/0025306 A1 * 1/2013 Matsukura ..... F25B 41/04 62/115
2013/0291567 A1 11/2013 Bohra et al.
2014/0174122 A1 * 6/2014 Cooper ..... F25J 3/061 62/618
2014/0245779 A1 9/2014 Bohra et al.
2014/0338371 A1 11/2014 Nierenberg
2015/0252948 A1 * 9/2015 Schmidt-Lussmann ..... F02M 21/06 122/32

FOREIGN PATENT DOCUMENTS

KR 10-0678852 B1 2/2007
KR 10-2015-0052980 A 5/2015
WO 03/085317 A1 10/2003

OTHER PUBLICATIONS

Written Opinion dated Dec. 22, 2016 in International Patent Application No. PCT/US2016/055503. [Cited in Parent].

* cited by examiner

LNG GASIFICATION SYSTEMS AND METHODS

CROSS-REFERENCE TO RELATED APPLICATIONS

This application claims priority to U.S. Nonprovisional application Ser. No. 15/285,965, filed Oct. 5, 2016, which claims priority to U.S. Provisional Application Ser. No. 62/237,223, filed on Oct. 5, 2015, the content of which are hereby incorporated herein by reference in their entirety.

TECHNICAL FIELD

The present invention relates generally to liquefied natural gas and, more particularly, to systems and methods for capturing refrigeration from gasification or vaporization of liquefied natural gas.

BACKGROUND

Liquefied Natural Gas (LNG) is a clean, viable source of heat and power. When natural gas is cooled and liquefied, the density increases about 600 times. In other words, LNG occupies about $1/600^{th}$ the volume or space than the same volume of natural gas vapor. LNG is, accordingly, easier to transport, and far more energy dense than natural gas in a vapor form. Liquefying natural gas into LNG, however, requires a significant amount of energy and special cryogenic tanks are needed to prevent rapid heat gain after the natural gas is liquefied.

When natural gas is liquefied into LNG, the energy content becomes more comparable to other liquid fuels. Nonetheless, as illustrated below, LNG generally provides less energy per gallon as compared to other fuels (measured in British Thermal Units (Btu)):

One gallon diesel=135,000 Btu

One gallon gasoline=125,000 Btu

One gallon Liquefied Petroleum Gas (LPG)=91,000 Btu

One gallon Liquefied Natural Gas (LNG)=83,000 Btu

These other fuels, including, for example, diesel, gasoline, kerosene, and propane, may be used in applications similar to LNG. However, as described below with respect to embodiments of the disclosed invention, unlike LNG, these other fuels do not provide significant "cold energy."

As a fuel, LNG is versatile and can be used in just about any way other fuels are used. These uses may be, for example, in boilers, dryers, power generation, marine fuel, locomotives, drilling rigs, asphalt plants, port operations, and over-the-road trucks. Once LNG arrives at an industrial site, it is vaporized or gasified into a gas for consumption. Prior to vaporization or gasification, LNG is not flammable and will not combust unless it is in a mixture with air where the natural gas is between 5% to 15% mixture with air. Vaporizing or gasifying LNG theoretically requires the same amount of energy from the environment as compared to the energy required to liquefy natural gas.

The amount of energy required to liquefy natural gas tends to vary with, for example, gas composition, gas pressure, product purity, product pressure, and refrigeration technology. With respect to liquefaction, for example, small scale liquefiers of less than about 500,000 gallons per day may require about 0.7 to 0.9 kWh/gallon of LNG, not including energy associated with inlet gas compressions, pretreatment, and other processes.

Conventional vaporization or gasification LNG systems and methods use various heat exchangers. The NFPA-59A Standard for Production, Storage, and Handling of Liquefied Natural Gas lists five options: (1) Ambient vaporizer, (2) Heated Vaporizer, (3) Integral Heated Vaporizer, (4) Remote Heated Vaporizer, and (5) Process Vaporizer. However, with the conventional vaporization or gasification LNG systems and methods, the cooled process fluid used to vaporize or gasify the LNG is discharged to the environment and/or the "cold energy" is not otherwise utilized.

SUMMARY

According to an embodiment, a method for capturing refrigeration is disclosed comprising providing a predetermined flowrate of liquefied natural gas to a first heat exchanger; providing a process fluid to the first heat exchanger, wherein the process fluid is warmer than the liquefied natural gas; heating at least a portion of the liquefied natural gas with at least a portion of the process fluid; calculating an amount of energy transferred in the first heat exchanger from the process fluid to the liquefied natural gas; and utilizing the process fluid for cooling.

According to another embodiment, a skid for capturing refrigeration from liquefied natural gas vaporization is disclosed comprising: a first heat exchanger mounted on the skid, the first heat exchanger having a natural gas inlet, a natural gas outlet, a process fluid inlet, and a process fluid outlet; wherein process fluid is configured to flow from the process fluid inlet through the first heat exchanger to the process fluid outlet and then to the process fluid inlet.

BRIEF DESCRIPTION OF THE DRAWINGS

The features and advantages of the invention will be apparent from the following drawings wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention.

As used herein, the term "about" or "approximately" when referring to a measurable value such as an amount, a temporal duration, and the like, is meant to encompass variations of ±20% or ±10%, more preferably ±5%, even more preferably ±1%, and still more preferably ±0.1% from the specified value, as such variations are appropriate to perform the disclosed methods.

Figure 1:
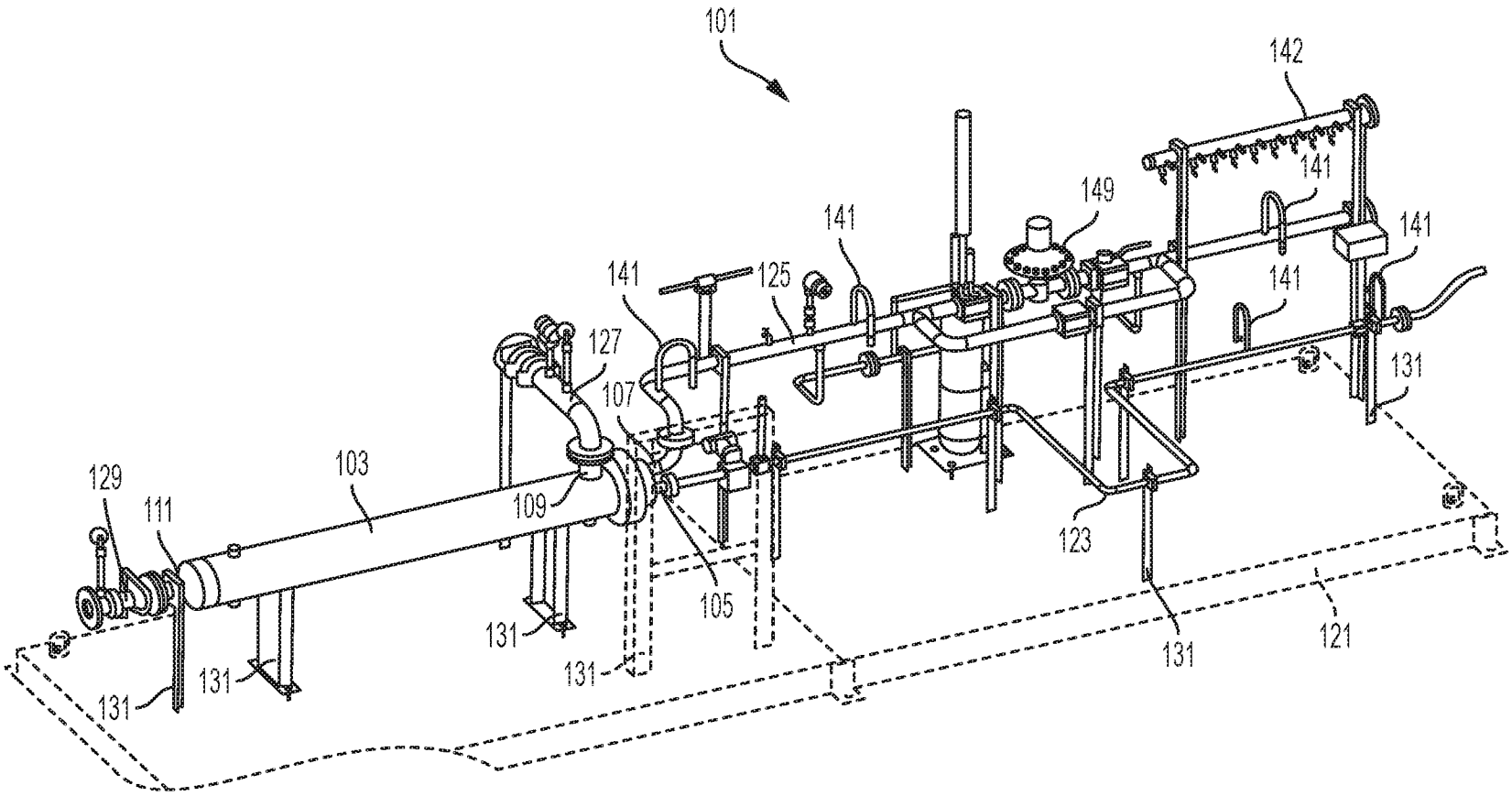
FIG. 1 is an embodiment of a vaporization or gasification system.
Figure 2:
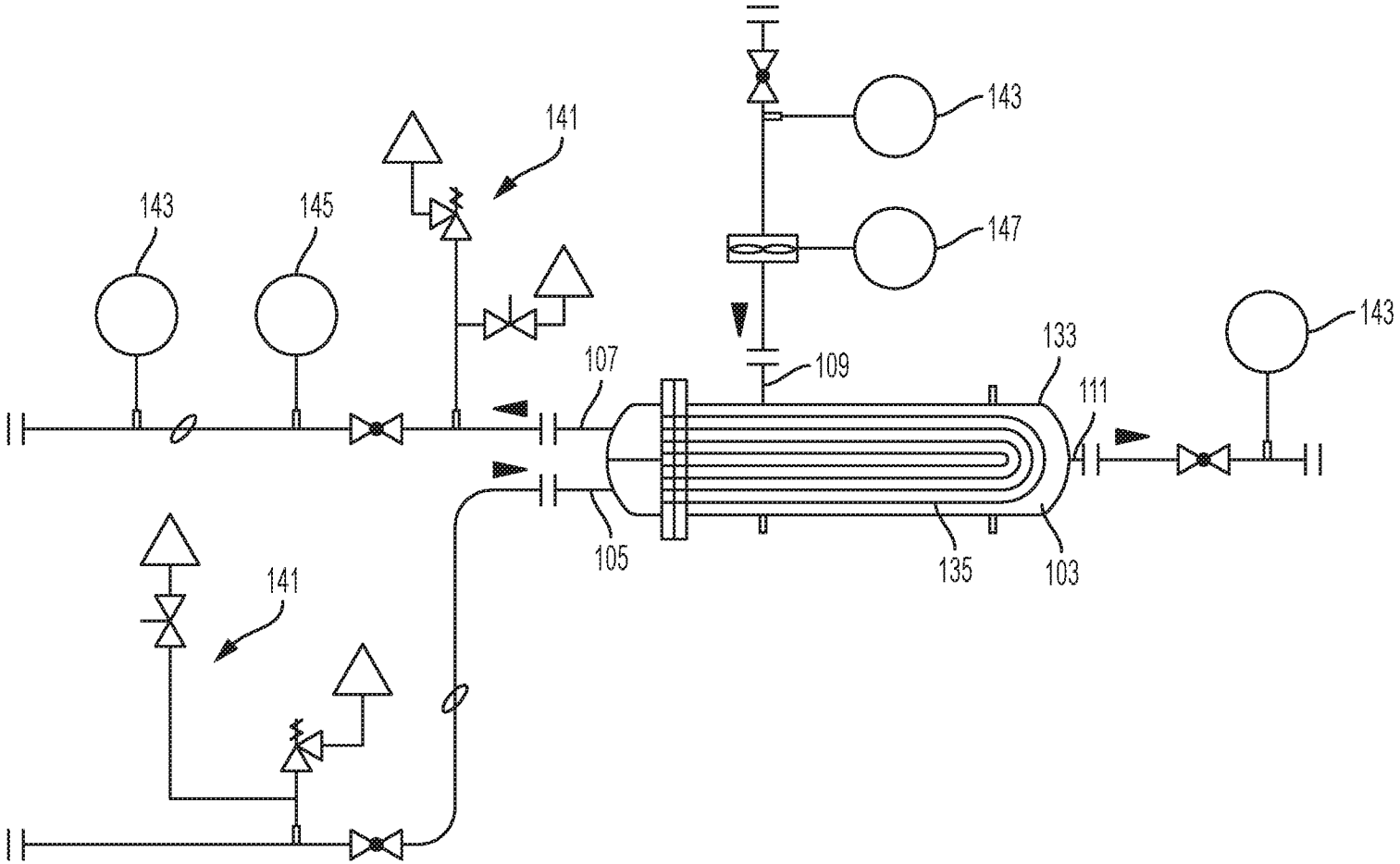
FIG. 2 is an embodiment of a vaporization or gasification system.

Referring now to FIGS. 1 and 2, an embodiment of an LNG vaporization or gasification system 101 is illustrated. The LNG vaporization or gasification system 101 generally comprises a heat exchanger or vaporizer 103 having an LNG inlet 105, a natural gas outlet 107, a warm process fluid inlet 109, and a cold process fluid outlet 111. According to an embodiment, the heat exchanger or vaporizer 103 may be mounted on a platform or skid 121 along with connecting piping and equipment, which are further described below.

According to an embodiment, the heat exchanger or vaporizer 103 may be a remote heated vaporizer. For example, in remote heated vaporizers, the primary heat source (e.g., heat exchangers, industrial equipment, heaters, etc.) is separated from the actual vaporizing heat exchanger, and an intermediate or process fluid is used as the heat transport medium from the primary heat source or sources to the heat exchanger or vaporizer. According to various embodiments, the process fluid may be, for example, but not limited to water, steam, isopentane, glycol, mixtures thereof or other fluids known to one of ordinary skill in the art.

As illustrated in FIG. 2, according to an embodiment, for example, the heat exchanger or vaporizer 103 may be a shell and tube heat exchanger. As known to one of ordinary skill the art, a shell and tube heat exchanger may generally comprises a shell 133 and a tube or tubes 135, which fluidly segregates fluid flowing in the shell 133 from fluid flowing through the tube or tubes 135. Such a configuration allows heat transfer between fluid flowing in the shell 133 and fluid flowing through the tubes 135. According to an embodiment, the process fluid enters the warm process fluid inlet 109 of the heat exchanger or vaporizer 103 and flows on the shell-side to the cold process fluid outlet 111 of the heat exchanger or vaporizer 103, and the LNG enters the LNG inlet 105 of the heat exchanger or vaporizer 103 and flows through the tube-side to the natural gas outlet 107 of the heat exchanger or vaporizer 103. According to other embodiments, the process fluid may flow through the tube-side and the LNG may flow through the shell-side of the heat exchanger or vaporizer 103.

According to still another embodiment, the heat exchanger or vaporizer 103 may comprise a counter-flow shell and tube heat exchanger where flow in the shell-side is counter to, or opposite, the flow in the tube-side. Such a flow configuration provides efficient heat transfer between, for example, LNG flowing through the tube-side and process fluid flowing through the shell-side of the heat exchanger.

As illustrated at FIG. 2, the heat exchanger or vaporizer 103 may provide a tortuous path from the LNG inlet 105 to the natural gas outlet 107 in the tubes 135 through the shell 133 having process fluid flowing therethrough. As further explained by the heat transfer equations below, heat transfer between the LNG in the tube or tubes 135 and process fluid in the shell 133 changes the phase of the natural gas from liquid to vapor. According to an embodiment, the heat exchanger or vaporizer 103 of the LNG vaporization or gasification system 101 may remove energy from a continuous or intermittent water stream flowing, for example, counter to the direction of flow of LNG.

The connecting piping may generally comprise piping 123 for fluidly connecting the LNG inlet 105 of the heat exchanger or vaporizer 103 to a position near or adjacent to an edge of the platform or skid 121, piping 125 for fluidly connecting the natural gas outlet 107 of the heat exchanger or vaporizer 103 to another position near or adjacent to an edge of the platform or skid 121, piping 127 for fluidly connecting the warm process fluid inlet 109 of the heat exchanger or vaporizer 103 to another position near or adjacent to an edge of the platform or skid 121, and piping 129 for fluidly connecting the cold process fluid outlet 111 of the heat exchanger or vaporizer 103 to another position near or adjacent to an edge of the platform or skid 121. For example, the connecting piping 123, 125, 127, 129 may be provided at positions near or adjacent to edges of the platform or skids 121 so that the platform or skid 121 may be easily placed on a site for installation with on-site or existing piping and equipment. Such a configuration may avoid damage to both on-site piping and equipment and piping and equipment located on the platform or skid 121. According to other embodiments, the connecting piping 123, 125, 127, 129 may extend past the edges of the skid or platform 121. According to still other embodiments, the connecting piping 123, 125, 127, 129 may not extend past the edges of the skid or platform 121.

The connecting piping 123, 125, 127, 129 may include various sizes of piping, tubing, flanges or threaded connections, valves, regulators, vents or pressure relief valves, and other types of pipes, valves, and fittings as known to one of ordinary skill in the art. Pipe and equipment supports 131 may be further included on the skid or platform 121 to support the connecting piping 123, 125, 127, 129 and other equipment located on the skid or platform (including the heat exchanger or vaporizer 103). The pipe and equipment supports 131 may raise the connecting piping 123, 125, 127, 129 and other equipment located on the skid or platform (including the heat exchanger or vaporizer 103) above the surface of the skid or platform 121 for operator access to the equipment.

According to an embodiment, the LNG vaporization or gasification system 101 may be configured to vaporize or gasify approximately 40,000 to 100,000 standard cubic feet per hour (scfh) of natural gas in approximately 10,000 scfh increments. According to other embodiments, the LNG vaporization or gasification system 101 may be configured to vaporize or gasify in approximately up to 40,000 scfh, up to 60,000 scfh, up to 80,000 scfh, up to 100,000 scfh flow rates. For example, for such embodiments, such natural gas flow rates allow for the heat exchanger 103 and other piping and equipment, further explained below, to be placed on one skid or platform 121, or a skid or platform 121 having multiple pieces. For example, the skid or platform 121 including the heat exchanger 103 and the other piping and equipment may be factory assembled so that the assembly can be quality tested in a controlled environment and then delivered to and installed on a site.

Referring still to FIGS. 1 and 2, the connecting piping 123, 125, 127, 129 may be configured to include various sensors, transmitters, and safety systems. For example, the connecting piping 123 and 125 may include pressure relief valves 141 to protect the system from over-pressure. According to an embodiment, a vent manifold 142 fluidly connected to the pressure relief valves 141 may be located on the skid or platform 121. The vent manifold 142 may provide a central and local location on the skid or platform 121 to vent natural gas or LNG from one or more pressure relief valves 141 during a pressure relief event.

According to an embodiment, the connecting piping 123, 125, 127, 129 may include temperature sensors and/or transmitters 143, pressure sensors and/or transmitters 145, and flow meters and/or transmitters 147. As explained in more detail below, the various sensors and transmitters may be used to control the LNG gasification or vaporization system 101 and optimize captured refrigeration capacity.

According to an embodiment, the connecting piping 125 may also include a regulator 149 to reduce the pressure of the natural gas to a predetermined pressure after it exits the heat exchanger or vaporizer 103. For example, the regulator may reduce the pressure to less than a maximum allowable operating pressure of boilers, dryers, power generation equipment, marine fuel equipment, locomotives, drilling rigs, asphalt plants, port operation equipment, over-the-road trucks, or other equipment requiring natural gas.

Figure 3:
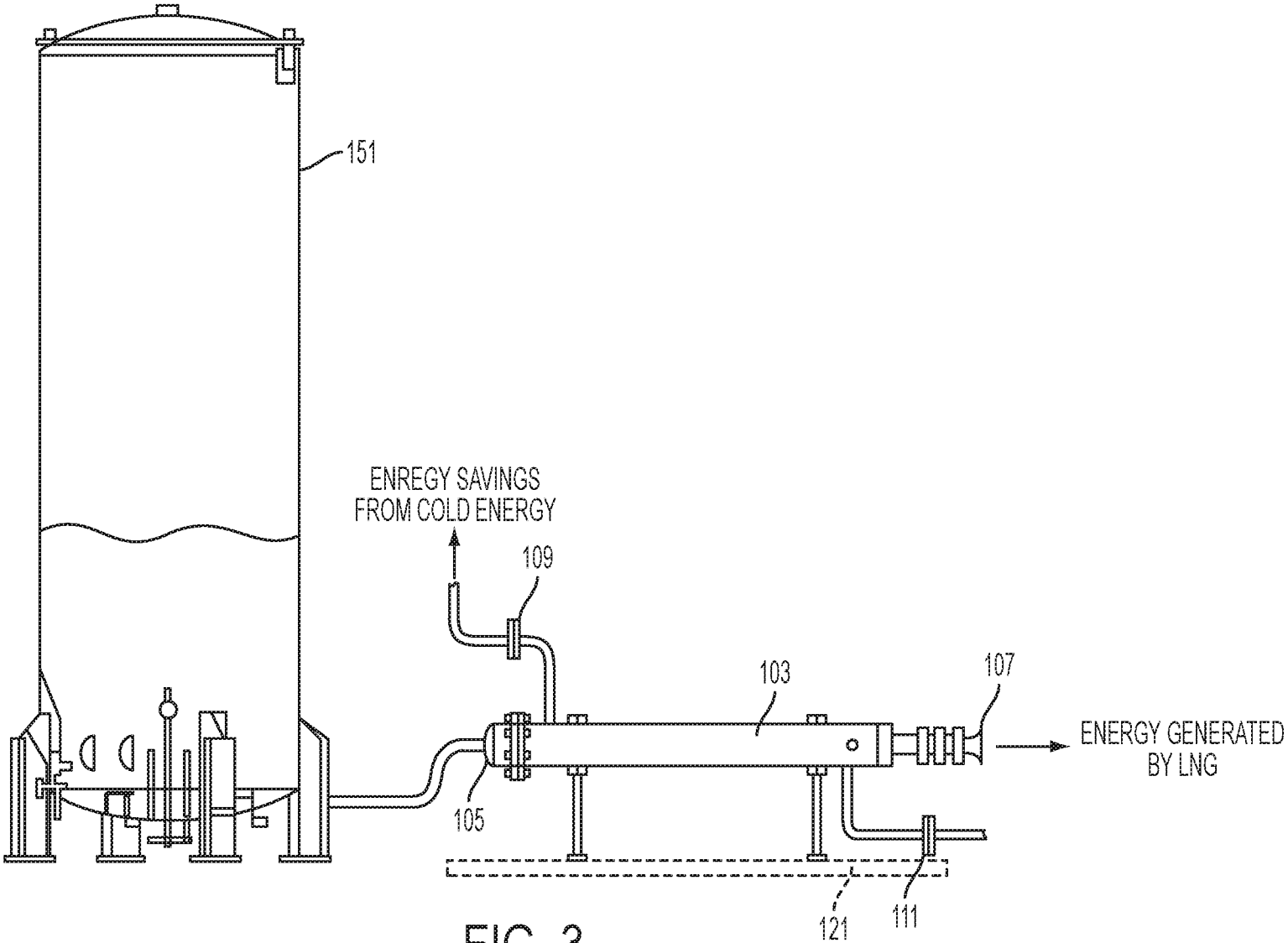
FIG. 3 is an embodiment of a heat exchanger and tank.

Referring now to FIG. 3, a simplified schematic is illustrated of a heat exchanger or vaporizer 103 with an LNG storage tank 151 fluidly connected thereto. According to an embodiment, more than one LNG storage tank 151 may be similarly fluidly connected to the heat exchanger or vaporizer 103. For example, the LNG storage tank 151 may be a vertical on-site cryogenic storage tank. According to an embodiment, the LNG storage tank 151 may be a vertical double-walled cryogenic tank which operates between, for example, 60 and 90 psig. The LNG storage tank 151 may be provided with pressure relief valves to vent natural gas if the operating pressure exceeds a predetermined maximum allowable working pressure of the LNG storage tank. According to an embodiment, the LNG storage tank 151 may be an annular tank which includes an inner tank and an outer tank having a vacuum space therebetween, along with insulation, in order to provide insulation and minimize the amount of heat that may enter the tank. The vacuum space may include molecular sieves to avoid matter entering the vacuum space and eliminate convective heat transfer. According to an embodiment, no metal-to-metal contacts are located between the inner and outer tanks in order to minimize conduction of heat.

As illustrated in FIG. 3, the LNG storage tank 151 may be fluidly connected to the LNG inlet 105 of the heat exchanger or vaporizer 103 such that LNG can flow from the LNG storage tank 151 to the LNG inlet 105 of the heat exchanger or vaporizer 103. For example, no pumping equipment may be needed to transfer LNG from the LNG storage tank 151 to the heat exchanger or vaporizer 103. According to an embodiment, the LNG storage tank 151 is located away from the platform or skid 121 and may store saturated liquid natural gas in a range of approximately 60 psig to 90 psig at a temperature of about −210° F. or conditions where the natural gas is in a liquid state.

As described above, the natural gas changes phase, from liquid to vapor, in the heat exchanger or vaporizer 103 by heat transfer with the process fluid. As the liquid natural gas changes to vapor, the natural gas undergoes a temperature increase, which is characterized herein as providing "Cold Energy," which is based on the change in enthalpy of the natural gas between the liquid phase and the vapor phase. According to embodiments, this Cold Energy can be captured and used in other processes.

Figure 4:
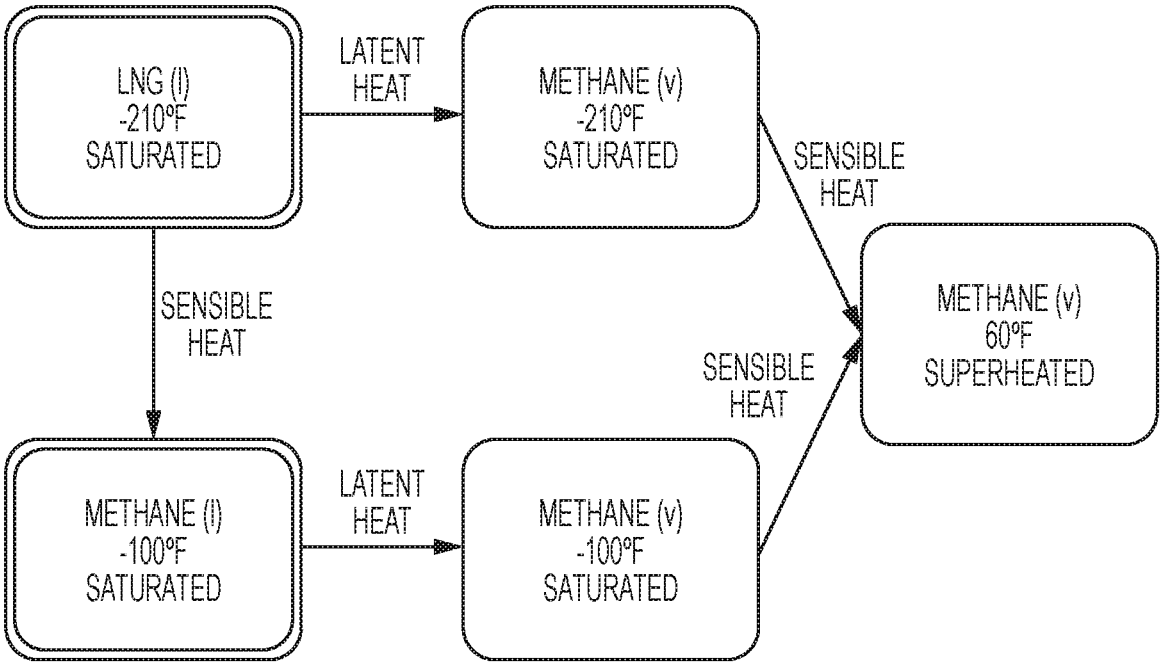
FIG. 4 is a an illustrative depiction of phase and state changes of natural gas.

According to embodiments illustrated at FIG. 4, the total enthalpy change is independent of the path from one state to another. For example, FIG. 4 illustrates that LNG may take different paths to ultimately achieve the same state, where the total enthalpy change of both paths is the same.

From a thermodynamic perspective, enthalpy is calculated as follows in equation (1):

$$H=U+pV \tag{1}$$

Where

H=enthalpy

U=internal energy p=pressure exerted by the natural gas

V=volume occupied by the natural gas

The Cold Energy (in Btu) captured by the process fluid is expressed in equation (2):

$$\text{Cold Energy}=\rho V*(\hat{h}_{sat}-\hat{h}_{vapor}) \tag{2}$$

Where $\hat{h}_{sat}$=enthalpy of saturated liquid $\hat{h}_{vapor}$=enthalpy of vapor V=volume occupied by the saturated liquid ρ=density of saturated liquid As illustrated by equation (2), the total difference in enthalpy is the total Cold Energy generated by the phase change of the natural gas, which depends on saturation conditions (i.e. temperature and pressure).

Refrigeration can be further calculated based on the change in enthalpy and the mass flowrate of LNG, according to equation (3):

$$1 \text{ ton of refrigeration}=12{,}000 \text{ Btu/hr} \tag{3}$$

According to embodiments, approximately half of the energy required to liquefy natural gas may be recovered upon vaporization or gasification, such as at a customer site. For example, Table 1 illustrates the Cold Energy recovered by embodiments of the present invention:

TABLE 1

| Power at the Liquifier: | | | Free Cold Energy: | |
|---|---|---|---|---|
| Energy In: kw-hr/LNG gal | 1 kw = Btu/hr | Btu/gal LNG | Energy Out: Btu/LNG gal | Free Cold % eff |
| 0.7 | 3412 | 2388 | 1229 | 51% |
| 0.9 | 3412 | 3071 | 1229 | 40% |

Illustrative Example 1

As a first illustrative example of an embodiment, the LNG storage tank 151 is configured to hold 14,000 gallons of LNG at 60 psig and natural gas vapor exits the heat exchanger or vaporizer 103 at 60 psig and 60° F., where the following conditions are met:

$\hat{h}_{sat}$=380.60 Btu/lbm $\hat{h}_{vapor}$=31.443 Btu/lbm

ρ=24.391 lbm/ft$^3$

V=1871.53 ft$^3$

Accordingly, the Cold Energy generated by Example 1 is 15.9*10$^6$ Btu or 15.9 million Btu (mmBtu). In other words, 15.9 mmBtu is required to vaporize 14,000 gallons of LNG.

Illustrative Example 2

As a second illustrative example of an embodiment, LNG is vaporized at the same conditions as Example 1 and the mass flowrate of LNG is 15 gallons per minute (gpm). According to Equations (2) and (3), the refrigeration capacity generated by vaporizing 15 gallons per minute of LNG is about 94 tons.

As described above, the Cold Energy can be extracted during the gasification or vaporization process and captured by the process fluid in the heat exchanger or vaporizer 103. In other words, the process fluid releases heat to the LNG. For example, based on an energy balance of the heat exchanger, the required flow rate to achieve a desired temperature of the process fluid at the cold process fluid outlet 111 of the heat exchanger or vaporizer 103 can be calculated by the following equations (4) and (5):

$$\text{Heat transfer of process fluid}=q_w=\dot{m}_w*c_p*(T_{w\ out}-T_{w\ in}) \tag{4}$$

$$\text{Heat transfer of LNG}=q_{LNG}=\dot{m}_{LNG}*(h_{LNG\ out}-h_{LNG\ in}) \tag{5}$$

Where:

$\dot{m}_w$=mass flowrate of process fluid $c_p$=heat capacity of process fluid $T_{w\ out}$=temperature of process fluid exiting the heat exchanger $T_{w\ in}$=temperature of process fluid entering the heat exchanger $h_{LNG\ out}$=enthalpy of natural gas exiting the heat exchanger $h_{LNG\ in}$=enthalpy of natural gas entering the heat exchanger Assuming an adiabatic process (i.e. no heat loss or gain from the environment), the required flow rate of the process fluid can be calculated as follows by the following equations (6) and (7):

$$q_w=q_{LNG}=\dot{m}_{LNG}*(T_{w\ out}-T_{w\ in})=\dot{m}_w c_p*(h_{LNG\ out}-h_{LNG\ in}) \quad (6)$$

$$\dot{m}_w=q_{LNG}/(c_p*(T_{w\ out}-T_w in)) \quad (7)$$

Illustrative Example 3

According to an embodiment, the process fluid may be, for example, but not limited to, water, glycol, or a water/glycol mixture. For purposes of a third illustrative example of an embodiment, LNG is vaporized at the same conditions as Example 1 and the mass flowrate of LNG is 15 gallons per minute and the process fluid is water with an inlet temperature of 60° F. with a desired outlet temperature of 32° F. Assuming an adiabatic process, the required flowrate of water at 1 atm can be calculated by Equation (7) as 73.1 gallons per minute where: $c_p$=heat capacity of water=1 Btu/lbm° F.

Figure 5:
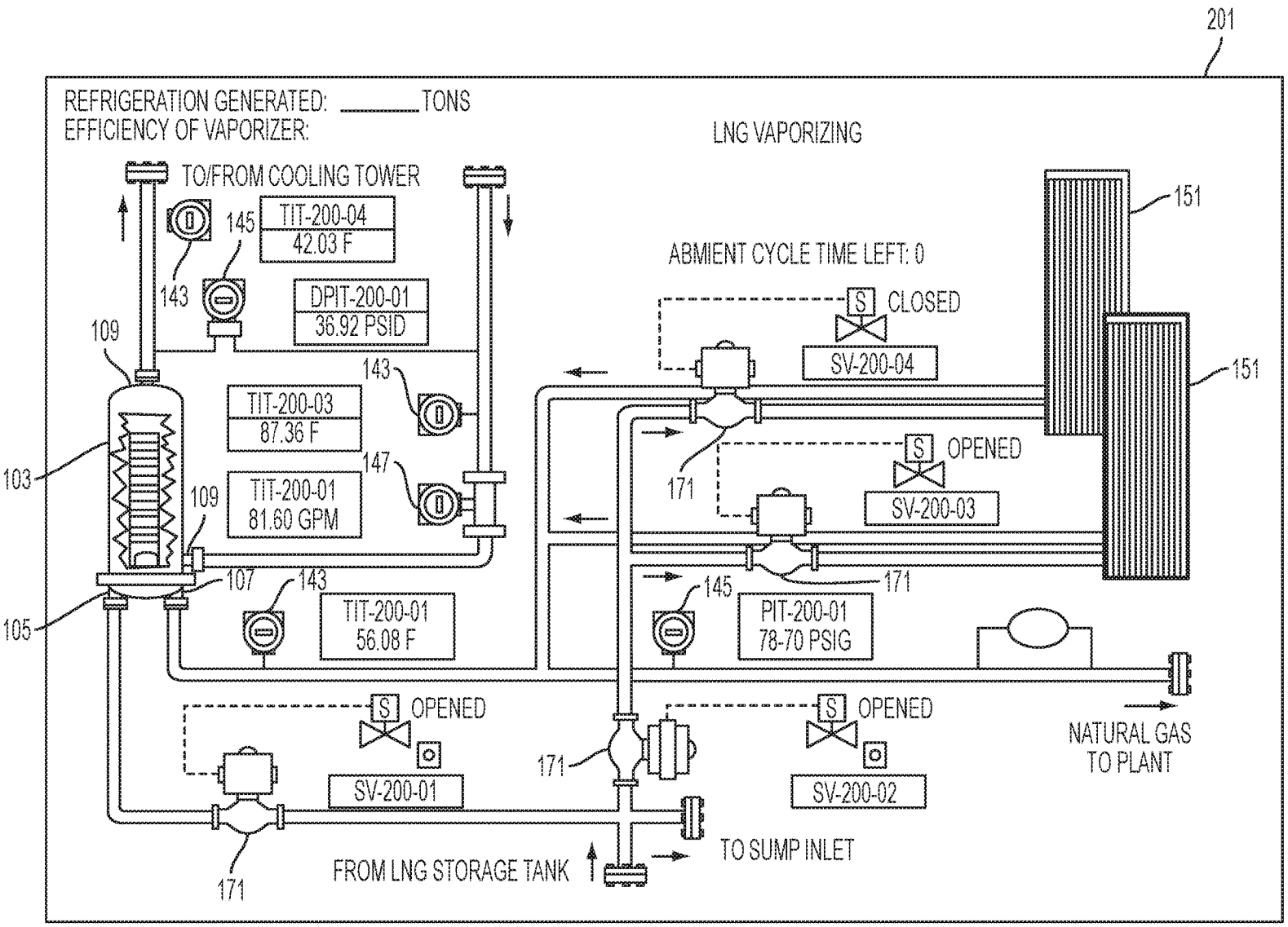
FIG. 5 is an embodiment of a display.

Referring now to FIG. 5, an embodiment of a display 201 is illustrated. The display 201 reflects equipment, piping, and sensors located on an embodiment of the platform or skid 121 of an LNG vaporization or gasification system 101. The display 201 shows a heat exchanger or vaporizer 103 having an LNG inlet 105, natural gas outlet 107, warm process fluid inlet 109, and cold process fluid outlet 111. The display 201 also indicates equipment that may be located off or away from the platform or skid 121, such as, for example, ambient vaporizers 161.

The display 201 indicates readings, such as real-time transmissions, from various sensors and/or transmitters located throughout the illustrated embodiment. On the process fluid piping, a temperature sensor/transmitter 143 and flow meter/transmitter 147 is located on the process fluid inlet piping to the heat exchanger or vaporizer 103. Another temperature sensor/transmitter 143 is located on the process fluid outlet piping from the heat exchanger or vaporizer 103, and may additionally include a flow meter/transmitter. A differential pressure sensor/transmitter 145 is located between the process fluid inlet and outlet piping. This differential pressure sensor/transmitter 145 may indicate, for example, freezing process fluid or other fouling in the heat exchanger or vaporizer 103. On the natural gas piping, other temperature and pressure sensors/transmitters 143, 147 may be located on the piping.

The display 201 indicates different flow paths of the LNG. From the LNG storage tank 151, the LNG may flow to either the heat exchanger or vaporizer 103, to the ambient vaporizers 161, or to a sump used, for example, for blowdown or recycle to the LNG storage tank 151. The flow of LNG may be controlled by various valves 171 to control LNG flow to either the heat exchanger or vaporizer 103, one or more ambient vaporizers 161, sump, or any combination thereof.

Figure 6:
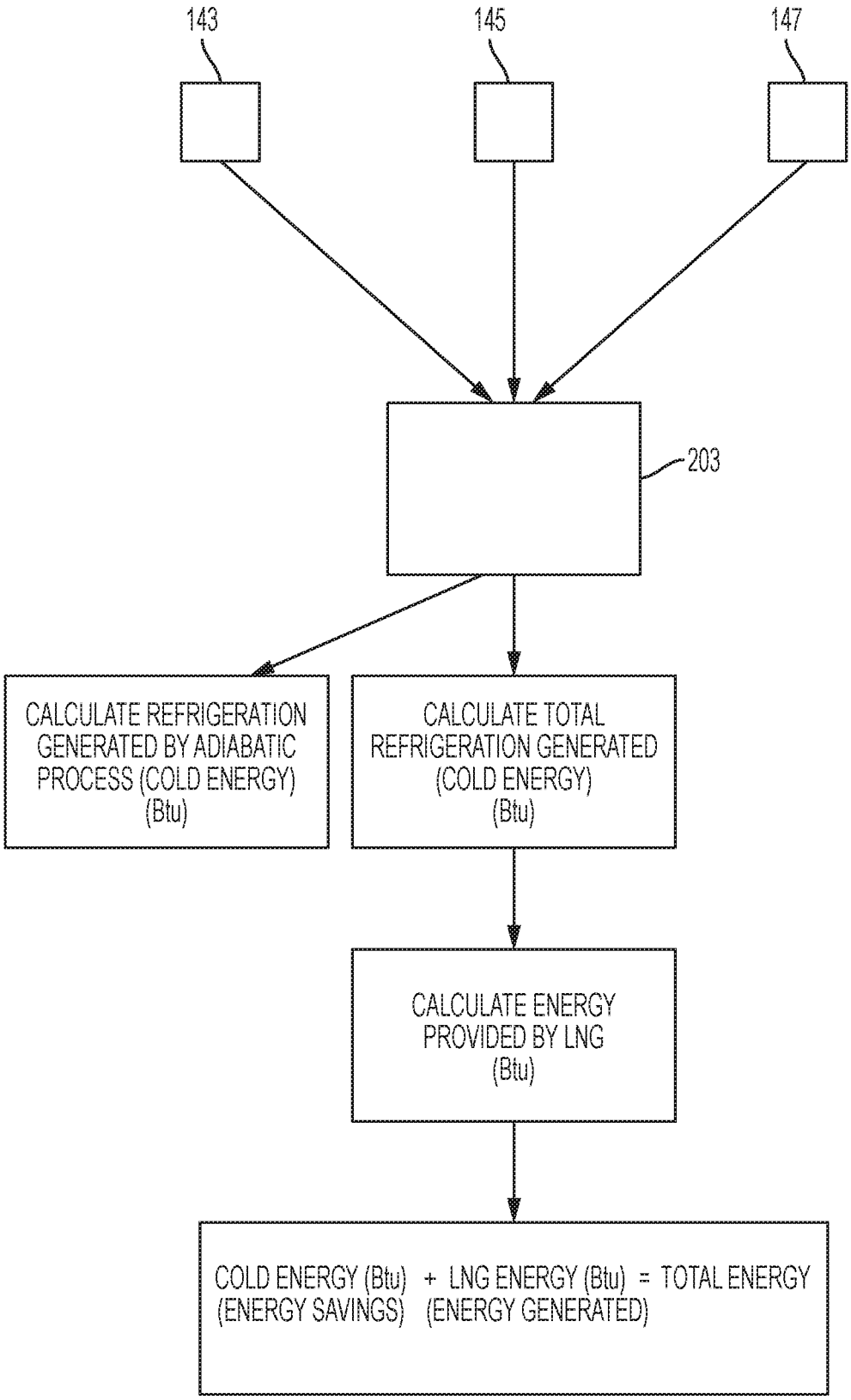
FIG. 6 is an embodiment of a controller.

Referring now to FIG. 6, the various sensors/transmitter readings from sensors/transmitters 143, 145, 147 reflected in the display 201 may be used in the above described equations and algorithms by a controller or programmable logic controller (PLC) 203 to calculate the total refrigeration generated and captured by the LNG vaporization or gasification system 101 and the efficiency of the vaporizer compared to an adiabatic process, explained above. As explained above, the controller or PLC 203 may calculate the Cold Energy expected to be generated by an adiabatic process of the LNG vaporization or gasification system 101 and compare it to the Cold Energy actually generated by the LNG vaporization or gasification system 101 in order to determine efficiency of the system. Further, the controller or PLC 203 may further calculate the Cold Energy actually generated by the LNG vaporization or gasification system 101 and calculate the total energy provided by the LNG to display the net energy resulting from energy savings (Cold Energy) and energy generated by the LNG.

According to an embodiment, the controller or PLC 203 may also track use of the ambient vaporizers 161 according to a predetermined length of time for using the ambient vaporizers 161. For example, at a predetermined length of flowing LNG through the ambient vaporizers 161, the controller 203 may divert LNG flow from one ambient vaporizer 161 to another in order to prevent freezing in the ambient vaporizers 161.

According to an embodiment, the controller or PLC 203 may further control the valves 171 in order to adjust the flow of LNG to prevent freezing in one or more of the ambient vaporizers 161. Further, the controller or PLC 203 may control the valves 171 to divert LNG flow to or away from the heat exchanger or vaporizer 103 according to refrigeration requirements of other equipment.

According to an embodiment, the controller or PLC 203 may control the flow of LNG to the heat exchanger or vaporizer 103 to be a predetermined flow rate. The controller or PLC 203 may adjust the predetermined flow rate of LNG to the heat exchanger or vaporizer 103 based on, for example, temperature of process fluid entering or exiting the heat exchanger or vaporizer 103. Further, the controller or PLC 203 may adjust the predetermined flow rate of LNG to the heat exchanger or vaporizer 103 based on, for example, flow rate of process fluid through the heat exchanger or vaporizer 103.

Figure 7:
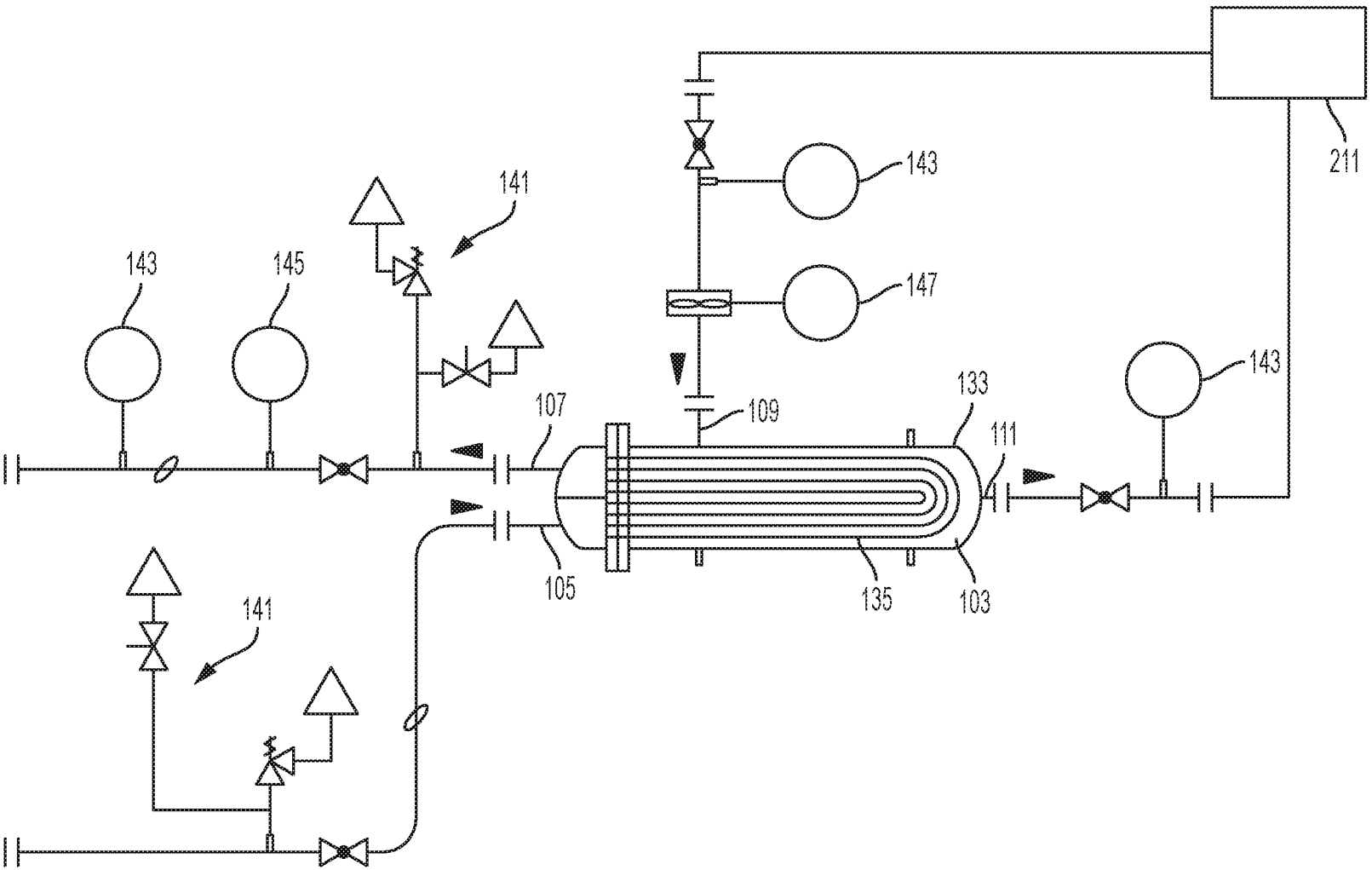
FIG. 7 is an embodiment of a vaporization or gasification system.
Figure 8:
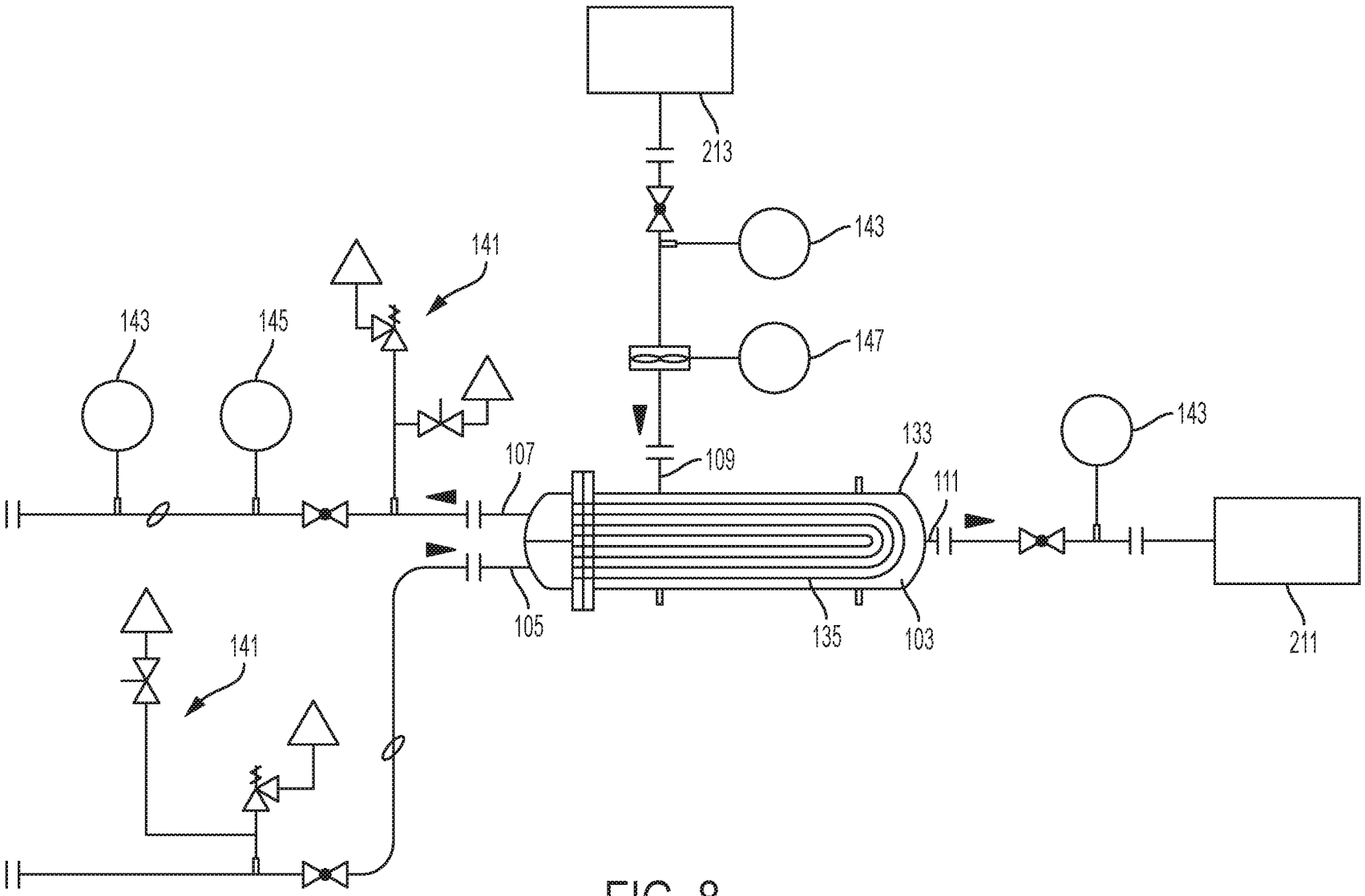
FIG. 8 is an embodiment of a vaporization or gasification system.

Referring to FIGS. 7 and 8, for example, different embodiments of a process are illustrated which depict process fluid flow. FIG. 7 illustrates, for example, a load 211 requiring refrigeration or cooling water. The load 211 utilizes the refrigeration captured by the process fluid and returns relatively warmer water back to the heat exchanger or vaporizer 103. FIG. 8 illustrates, for example, a load 211 requiring refrigeration or cooling water where the load 211 similarly utilizes the refrigeration captured by the process fluid but discharges otherwise utilizes the cooling water elsewhere. A heat source 213 provides the relatively warmer water to the heat exchanger or vaporizer 103.

Figure 9:
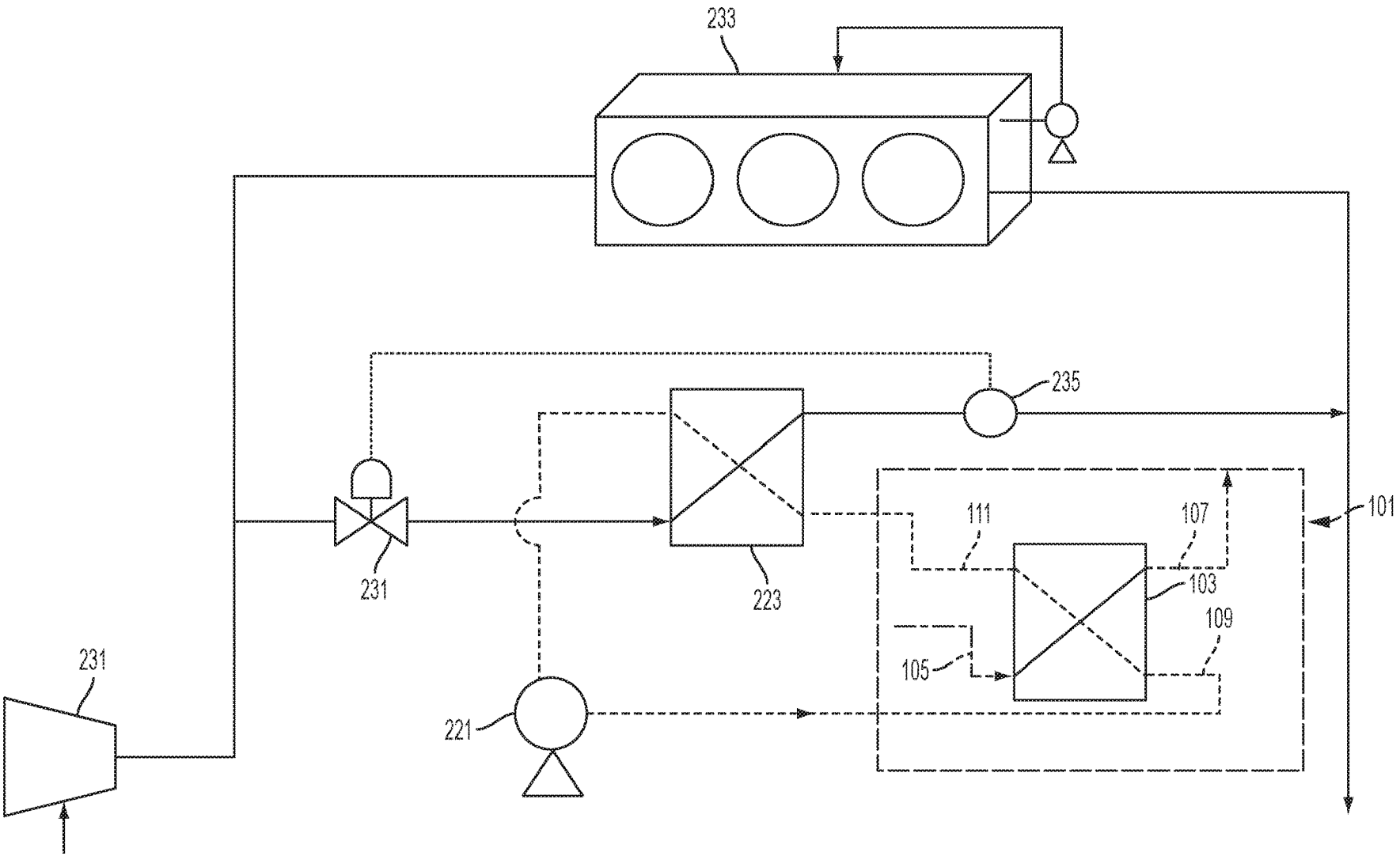
FIG. 9 is an embodiment of an industrial processing including a vaporization or gasification system.

Referring now to FIG. 9, another embodiment is illustrated of an LNG vaporization or gasification system 101. For example, the LNG vaporization or gasification system 101 may include the system as depicted in FIG. 1 and the display and controls of FIGS. 5 and 6. According to an embodiment, the process fluid, such as glycol or water or glycol-water mixture, may be pumped through the heat exchanger or vaporizer 103 by at least one or more pumps 221. After the process fluid captures the Cold Energy through the heat exchanger or vaporizer 103, the process fluid may flow through a process heat exchanger 223 to provide the Cold Energy to an industrial process such as, for example, an $NH_3$ or ammonia system. According to an embodiment, an ammonia compressor 231 may provide ammonia to the process heat exchanger 223 (via control valve 231) or to one or more ammonia condensers 233. The control valve 231 may adjust the flow from the ammonia compressor 231 to the process heat exchanger 223 by based on a predetermined temperature set point of ammonia measured by temperature sensor 235 downstream of the process heat exchanger 223. For example, such a configuration may reduce the load and energy requirements of the condensers 233.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A method for capturing refrigeration comprising:

providing a predetermined flowrate of liquefied natural gas to a first heat exchanger, wherein the liquefied natural gas flows through a tube-side of the first heat exchanger;

providing a process fluid to the first heat exchanger, wherein the process fluid is warmer than the liquefied natural gas, wherein the process fluid flows through a shell-side of the first heat exchanger, and wherein the liquefied natural gas flows in a direction counter to a direction of flow of the process fluid in at least a portion of the first heat exchanger;

heating at least a portion of the liquefied natural gas with at least a portion of the process fluid;

calculating, with a controller, an amount of energy transferred in the first heat exchanger from the process fluid to the liquefied natural gas;

changing, with the controller, the predetermined flowrate of liquefied natural gas to the first heat exchanger based on a temperature of the process fluid entering the heat exchanger and based on a desired temperature of the process fluid leaving the heat exchanger; and utilizing the process fluid leaving the heat exchanger for cooling an external load requiring refrigeration, wherein changing the predetermined flowrate of liquefied natural gas to the first heat exchanger includes diverting a flow of the liquefied natural gas to or away from the first heat exchanger according to the refrigeration required by the external load.

2. The method of claim 1, further comprising displaying on a user display an amount of energy transferred in the first heat exchanger from the process fluid to the liquefied natural gas.

3. The method of claim 1, further comprising:

calculating, with the controller, an amount of energy of the liquefied natural gas;

adding, with the controller, the calculated amount of energy transferred in the first heat exchanger from the process fluid to the liquefied natural gas to the calculated amount of energy of the liquefied natural gas; and displaying on a user display the added amount of energy transferred in the first heat exchanger from the process fluid to the liquefied natural gas and amount of energy of the liquefied natural gas.

4. The method of claim 1, wherein utilizing the process fluid for cooling comprises pumping the process fluid to a second heat exchanger and then returning the process fluid to the first heat exchanger.

5. The method of claim 1, wherein the first heat exchanger is a shell-and-tube heat exchanger, a vaporizer, or a remote heated vaporizer.

6. The method of claim 1, wherein the process fluid comprises water or glycol.

7. A skid for capturing refrigeration from liquefied natural gas vaporization comprising:

a first heat exchanger mounted on the skid, the first heat exchanger having a natural gas inlet, a natural gas outlet, a process fluid inlet, and a process fluid outlet, wherein the first heat exchanger is a shell-and-tube heat exchanger, wherein liquefied natural gas is configured to flow through a tube-side of the first heat exchanger and a process fluid is configured to flow through a shell-side of the first heat exchanger, and wherein the liquefied natural gas is configured to flow in a direction counter to a direction of flow of the process fluid in at least a portion of the heat exchanger;

an external load configured to be cooled by a process fluid leaving the first heat exchanger; and valves configured to control a predetermined flowrate of the liquefied natural gas to the first heat exchanger, the valves configured to control the predetermined flowrate by diverting a flow of the liquefied natural gas to or away from the first heat exchanger according to a refrigeration required by the external load, wherein the process fluid is configured to flow from the process fluid inlet through the first heat exchanger to the process fluid outlet and then to the process fluid inlet, wherein the predetermined flowrate of liquefied natural gas to the first heat exchanger is based on the temperature of process fluid entering the first heat exchanger and based on the desired temperature of process fluid leaving the first heat exchanger.

8. The skid of claim 7, further comprising connecting piping extending from each of the natural gas inlet, natural gas outlet, process fluid inlet, and process fluid outlet of the first heat exchanger to an edge of the skid.

9. The skid of claim 7, wherein the process fluid is configured to flow from the process fluid outlet of the first heat exchanger to a second heat exchanger.

10. The skid of claim 7, wherein the process fluid is configured to flow from a second heat exchanger to the process fluid inlet of the first heat exchanger.

11. The skid of claim 7, further comprising a vent manifold mounted to the skid, wherein the natural gas inlet and the natural gas outlet of the first heat exchanger is fluidly connected to the vent manifold.

12. The skid of claim 7, wherein the natural gas outlet of the first heat exchanger comprises a regulator for reducing the pressure of natural gas flowing from the first heat exchanger.

13. The skid of claim 7, wherein the first heat exchanger is configured to vaporize approximately 40,000 to 100,000 standard cubic feet per hour of natural gas.

14. The method of claim 1, wherein providing the predetermined flowrate of liquefied natural gas to the first heat exchanger includes transferring the liquefied natural gas from a liquefied natural gas storage tank to the first heat exchanger without a pump.

15. The method of claim 1, wherein the desired temperature of the process fluid is based on the refrigeration required by the external load.

16. The method of claim 1, further comprising: returning the process fluid after cooling the external load to the first heat exchanger for cooling the process fluid, the process fluid returning to the first heat exchanger having a higher temperature than a temperature of the process fluid leaving the heat exchanger.

17. The method of claim 1, further comprising: returning the process fluid after cooling the external load to a second heat exchanger distinct from the first heat exchanger for cooling the process fluid, the process fluid returning to said second heat exchanger having a higher temperature than a temperature of the process fluid leaving the first heat exchanger.

* * * * *